US006219894B1

(12) United States Patent
Lotz

(10) Patent No.: US 6,219,894 B1
(45) Date of Patent: Apr. 24, 2001

(54) DEBURRER FOR CONTINUOUS STEEL CASTING INSTALLATION

(75) Inventor: Horst K. Lotz, Hofheim-Wallau (DE)

(73) Assignee: Gega Corporation, Pittsburgh, PA (US)

( * ) Notice: Subject to any disclaimer, the term of this patent is extended or adjusted under 35 U.S.C. 154(b) by 0 days.

(21) Appl. No.: 09/393,033

(22) Filed: Sep. 9, 1999

(30) Foreign Application Priority Data

Oct. 10, 1998 (EP) ..... 98118998

(51) Int. Cl.[7] ..... B23P 17/00; B23D 1/22; B23D 11/12

(52) U.S. Cl. ..... 29/33 A; 409/300; 409/301

(58) Field of Search ..... 29/33 A, 81.17, 29/81.11; 409/293, 298, 299, 300, 301, 303; 225/47, 103, 104

(56) References Cited

U.S. PATENT DOCUMENTS

| | | | | |
|---|---|---|---|---|
| 3,377,896 | | 4/1968 | De Corta . | |
| 3,515,029 | | 6/1970 | Gambini . | |
| 4,357,817 | | 11/1982 | Linsinger . | |
| 4,362,448 | | 12/1982 | Hasebe et al. . | |
| 4,672,726 | * | 6/1987 | Delbecq et al. | 29/33 A |
| 4,704,241 | | 11/1987 | Boggs . | |
| 4,859,126 | * | 8/1989 | Mancuso | 409/293 |
| 5,179,772 | | 1/1993 | Braun et al. . | |
| 5,253,398 | | 10/1993 | Markiewicz . | |
| 5,259,440 | | 11/1993 | Lotz et al. . | |
| 5,597,030 | | 1/1997 | Lotz et al. . | |
| 5,626,181 | | 5/1997 | Lotz et al. . | |
| 5,765,271 | * | 6/1998 | Lotz et al. | 29/33 A |

FOREIGN PATENT DOCUMENTS

| | | |
|---|---|---|
| 3116943 A1 | 12/1982 | (DE) . |
| 84 24 289 U | 10/1985 | (DE) . |
| 3700207 A1 | 7/1988 | (DE) . |
| 0198768 A1 | 6/1987 | (EP) . |
| 0 240 130 | 7/1987 | (EP) . |
| 0 463 201 A1 | 11/1993 | (EP) . |
| 0 724 923 B1 | 12/1994 | (EP) . |
| 19/961024 | 10/1996 | (EP) . |
| 0 672 487 B1 | 1/1997 | (EP) . |
| 0 947 264 A2 | 4/1997 | (EP) . |
| 0 671 230 B1 | 5/1997 | (EP) . |
| 0 947 263 A1 | 2/1998 | (EP) . |
| 56-21712 | 2/1981 | (JP) . |
| 58-71022 | 4/1983 | (JP) . |
| 3-210951 | 9/1991 | (JP) . |
| 4-270044 | 9/1992 | (JP) . |
| 1389946 A1 | 4/1988 | (RU) . |
| WO 90/06195 | 6/1990 | (WO) . |

* cited by examiner

*Primary Examiner*—William Briggs
(74) *Attorney, Agent, or Firm*—Alan G. Towner; Brij K. Agarwal; Eckert Seamans Cherin & Mellott, LLC

(57) ABSTRACT

The invention shows a travelling deburrer for cutting burrs (2) developing when steel strands are subdivided by oxygen cutting. The deburrer achieves safe deburring with high deburring rates with the help of cost and space reducing designs regarding drive, control and tools, by increased deburring energy and by a more advantageous blade design.

11 Claims, 4 Drawing Sheets

DEBURRER FOR CONTINUOUS STEEL CASTING INSTALLATION

BACKGROUND INFORMATION

In continuous casting plants the continuously cast strands are subdivided into strand pieces by oxygen cutting machines. During the oxygen cutting process cutting burrs of iron oxides which are developing on the lower edges of the cut surfaces, gradually turn into a connection zone of pure steel.

These cutting burrs are a quality-reducing and cost increasing source of annoyance for further treatment. Therefore they have to be removed as soon as possible in the fabrication process by gastechnical or mechanical means.

Preferably the burrs are removed mechanically, for this advantageous proposals are given in EPA 94 103 765.7 and 94 119 274.2.

Figure 1:
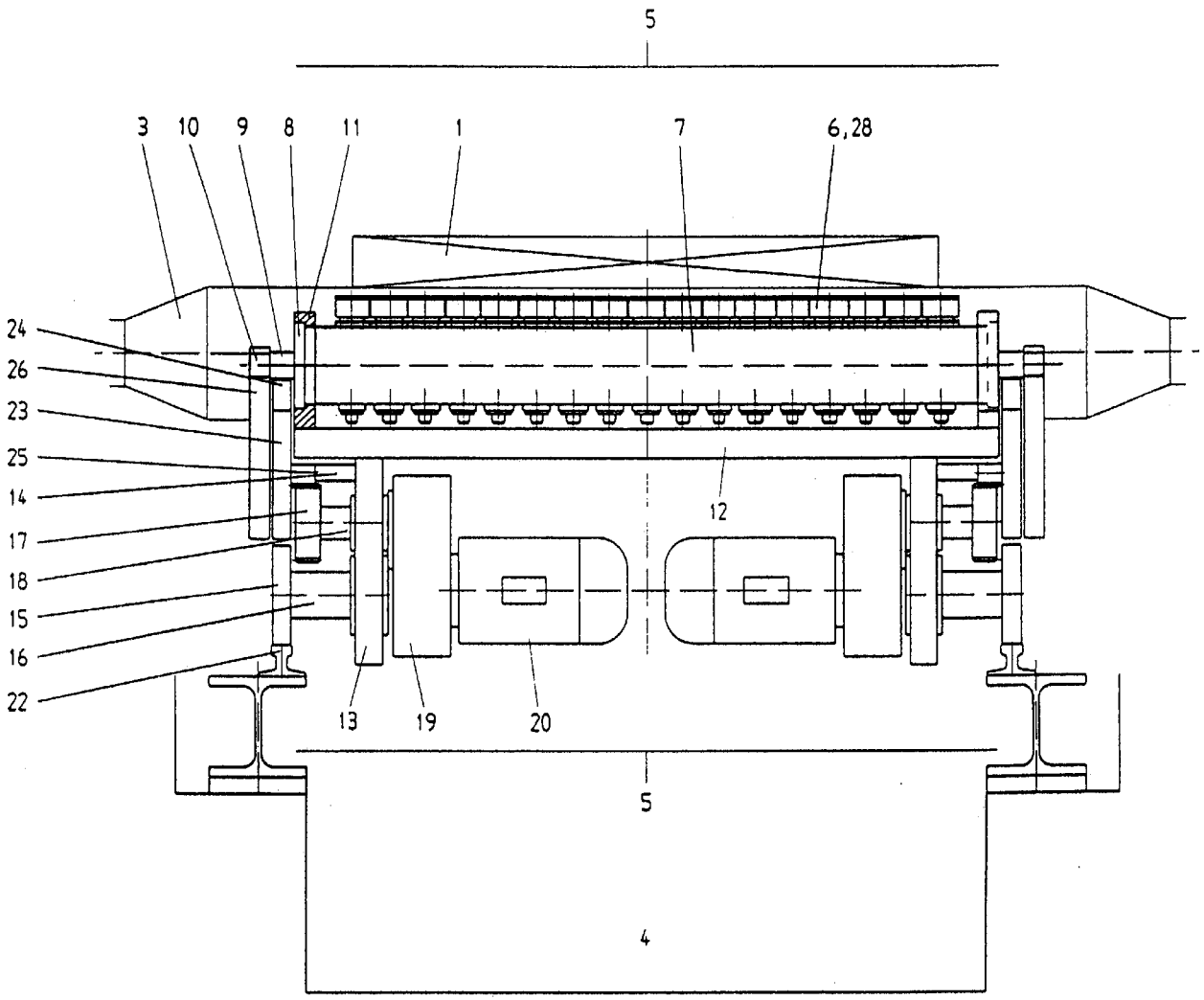
FIG. 1 is a front elevational view of a deburrer that can be modified in accordance with the present invention.

DETAILED DESCRIPTION in order to explain the invention presented here, reference is made to the above mentioned principle of EPA 94 103 765.7, where the front burr (2) is removed by travelling parallel and overtaking and the back burr (2) by counter-running in a gap between two rolls (3), once the oxygen cutting is finished and that in a safe, low noise and efficient manner with smallest efforts.

For that the piston body (7) is turned by approximately 60° to 90° after each deburring procedure in order to throw off any cutting burrs (2) on it into a channel (4) and to keep a distance from the lower surface of the strand piece (1).

Figure 2:
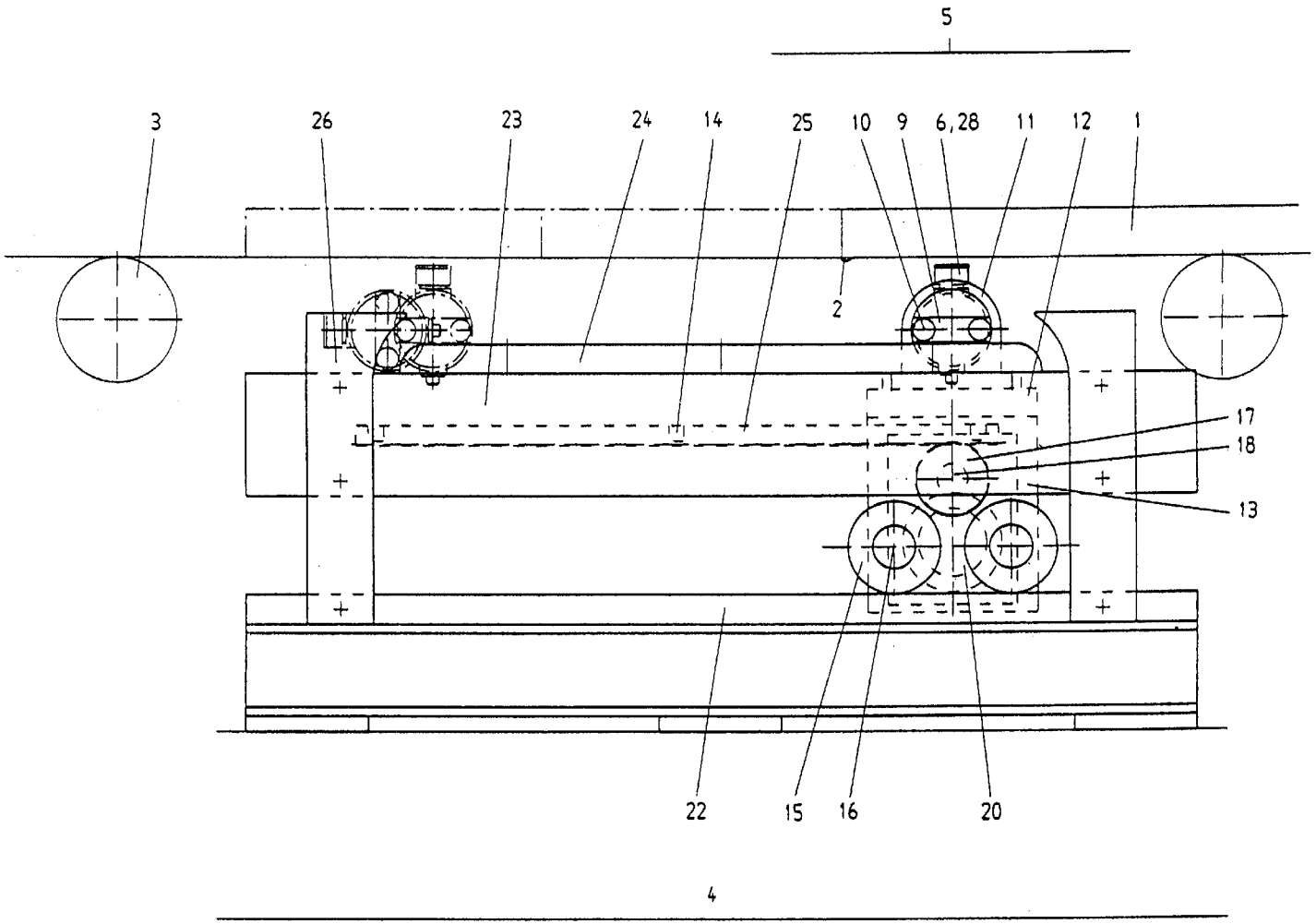
FIG. 2 is a side elevational view of the deburrer.

Therefore such a deburrer as shown in FIGS. 1 to 2 consists of a deburring carriage (5) which is welded together with a beam (12) and two cheeks (13). On the outside of the cheeks (13) 3 or 4 travelling wheels (15) without guide flanges are installed in wheel bearings (16), the wheels (15) travelling on a lower rail (22) and being prevented from rising during a tilting procedure by the help of an upper rail (23). On the outside of the cheeks (13) there are also fixed two pinions (17) in pinion bearings (18) which comb with racks (25), the latters serving also as guide rails (25). Inside the cheeks (13) the pinions (17) are driven by two drives which consist of a gear box (19) with cheek-penetrating shafts and electrical motors (20). There are also fixed guide bars (14) of slide-propitious material on the outside of the cheeks (13) which slide along the planed sides of the racks (25) thereby also serving as guide rails (25) guiding the deburring carriage (5).

On the beam (12) of the deburring carriage (5) two pivot bearings (11) are installed which allow to turn the piston body (7) with its impressable deburring pistons (6) at its cover ends (8) machined for the pivot bearing (11).

Normally horizontally aligned sliding blocks (9) are installed on the front surfaces of the cover ends (8), slide along on the slide rails (24) on the upper face of the upper rail (23) on and keep the deburring pistons (6) in the piston body (7) in vertical position. In case a small angle between the lower surface of the strand piece (1) and the deburring piston (6) is required, it can be easily produced for self-adjustment by a gap between the sliding blocks (9) and the slide rails (24).

The slide rails (24) at the end of the rail system are cut back to enable a rotation of the sliding blocks (9) with the piston body (7) initiated by a deflect stop (26) with inclined stop face which forces the piston body (7) still slowly travelling because of the deburring carriage (5) to be rotated by the pusher knobs (10) in a design-stipulated number of degrees.

When travelling out of the final position the slide rails (24) force the piston bodies (7) to align straight or nearly straight again by the help of the sliding shoes (9).

A working cycle for 2 deburring procedures with this kind of deburrer is carried out like follows:

The deburrer which is situated below the arriving strand piece (1) is switched into synchronized travel mode by the help of a position indicator i.e. a light barrier and travels with the drive while the piston body (7) turns up simultaneously and the deburring pistons (6) are pressed in by the lower surface of the strand piece (1). After a higher speed is switched-on, the deburring pistons (6) overtake the forward end of the strand piece (1), deburr, jump up and thereby strike-off horizontal burr rests and are turned away in the other final position in a cleaning way and opening the passage for the strand piece (1). Before travelling over the back end of the strand piece (1)the starting of the deburrer is initiated again correspondingly. The deburrer turns the piston body (7) upwards, presses against the lower surfaces with the deburring piston (6), tilts into the small deburring angle and deburrs the cutting burr (2) at the backward end of the strand piece (1) which can be either stationnary or running in opposite direction. Thereafter the deburrer returns to the starting position to rotate away and to wait for the following strand piece (1).

With 'counter-deburring'—strand piece (1) and deburring carriage (5) run against one another—the energy required for deburring or knocking-off of the cutting burr (2) is the sum of the respective kinetic energy, whereby the strand piece (1) also has a very big portion of the disposable total energy because of its weight:

$$\frac{m_{(1)} \cdot V_{(1)}^2}{2} + \frac{m_{(5)} \cdot V_{(5)}^2}{2}$$

Equal energy portions of the disposable total energy are consumed until the complete deburring is finished. However, when deburring a travelling out strand piece (1) the disposable deburring energy is reduced by that produced by the deburring carriage (5). The travelling out of the strand piece (1) changes the deburring energy by reduction of the relative speed and also by plastic deformation of the often still rather hot and large cutting burr (2).

This energy reduction can only be compensated by an increase of the energy of the deburring carriage (5). In order to achieve this result the average expert will increase the weight, i.e. the mass of the deburring carriage (5) and its speed. However, the constructive possibilities are restricted because of space, travel and brake path as well as of cost reasons.

According to the invention and as proposed in FIG. 1 the installation of a disk flywheel (27) at a second shaft end of one of the drive motors and its connection with the second shaft end of the other electrical motor (20) by a clutch is foreseen, whereby both electrical motors (20) are designed as asynchronous motors because of the adopting slippage. This results in considerable, by number of motor rotation easily adjustable and space saving energy increases with corresponding brake possibilities.

Figure 3:
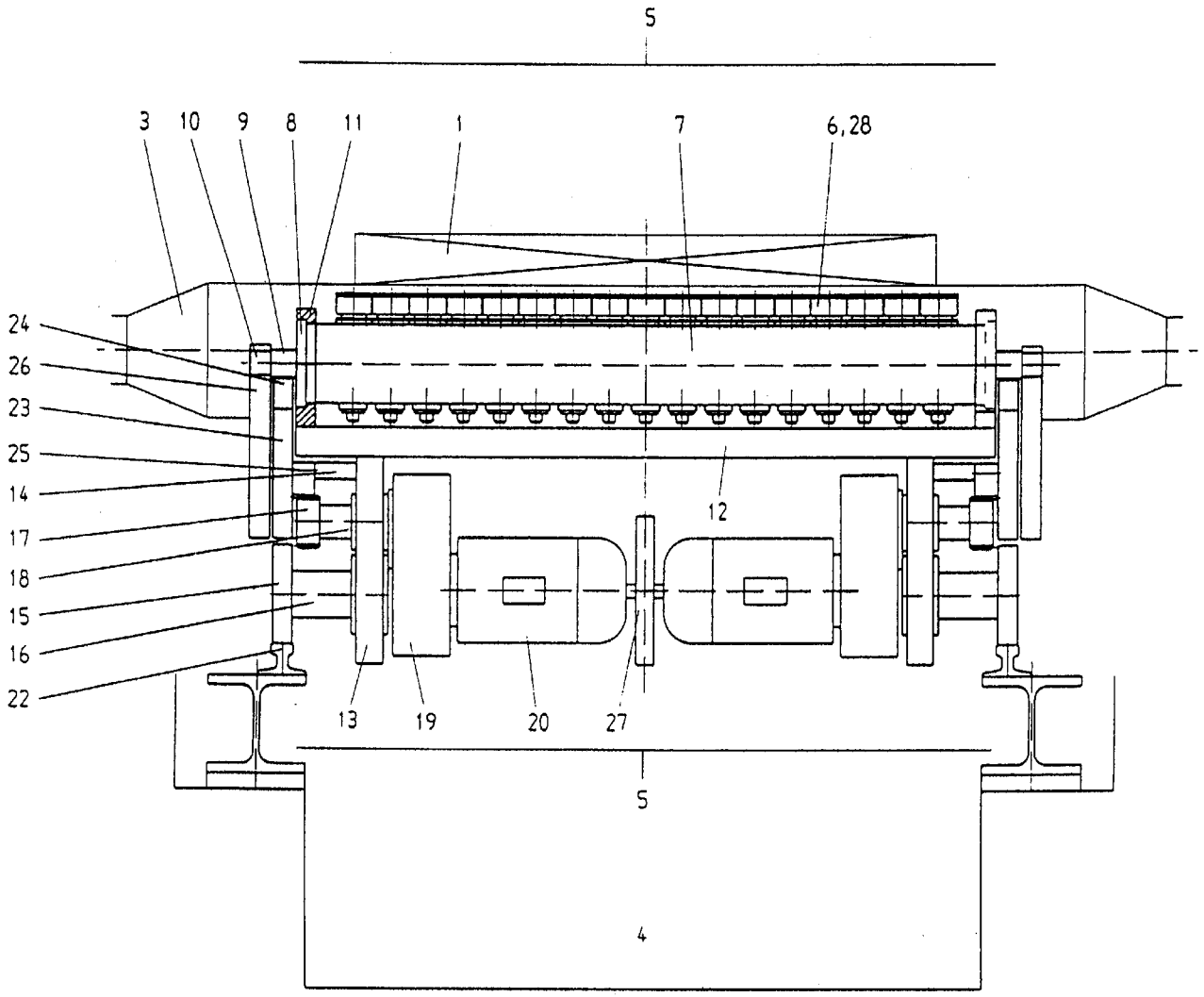
FIG. 3 is a front elevational view of a deburrer in accordance with the present invention.

FIG. 3 furthermore proposes to design the pinions (17) possibly small—minimum number of teeth with smallest module—in production balanced by high-tensile materials. This creates an increase of the propulsion moment as such a ratio uses the motor moment in the best possible way with equal motor and drive (19).

FIG. 3 proposes to carry out the deburring as double stroke as follows. The overtaking deburring carriage (5) quickly follows the cutting burr (2), knocks against it with its deburring pistons (6) and stops in case there should not occur a quick continuation of the run, travels back a short distance and performs a second start with a second deburring stroke in the area of the available deburring distance. A corresponding control can easily be realized by the help of limit switches, light indicators, time relays and current measurement of the electrical motors.

Figure 4A:
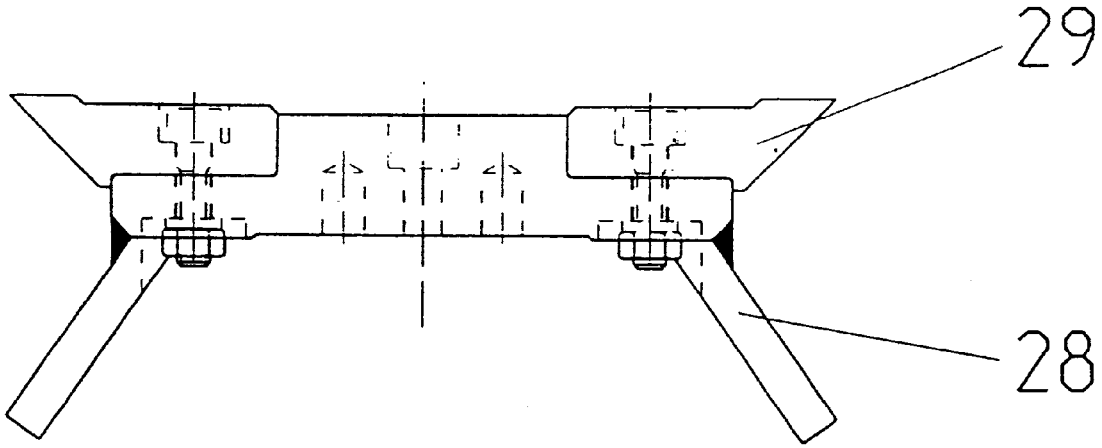
FIG. 4*a* is a front elevational view of a deburring chisel in accordance with the present invention.
Figure 4B:
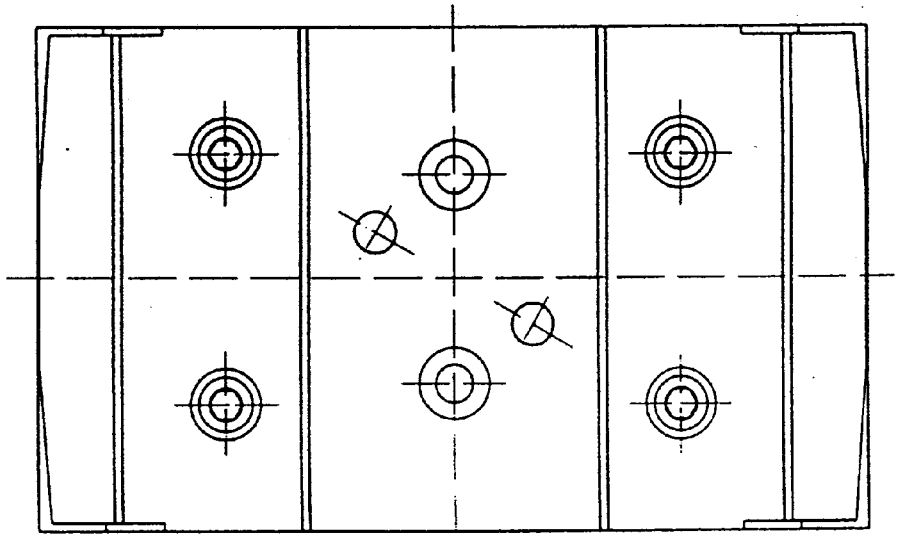
FIG. 4*b* is a top plan view of the deburring chisel.

FIGS. 4*a* and 4*b* show a new deburring chisel (28) which is not designed as round deburring cap but as a rectangle, surpassing the deburring piston with inclined, interchangeable deburring blades (29) which are supported by a shoulder and are manufactured of special material expensive in cost and production.

What is claimed is:

1. Deburrer for continuous steel casting installation for elimination of cutting burrs from continuously cast strand pieces, comprising a deburring carriage carrying a pivotable piston body with a plurality of deburring pistons which can be pressed in elastically, wherein the deburring carriage comprises two pinions, two gear boxes, and two speed-adjustable asynchronous three-phase current electrical motors which act as a deburring carriage drive, whereby the pinions, gear boxes, and motors are mirror-invertedly arranged in the machine with the pinions engaged in racks and the two mirror-invertedly arranged motors are connected by a disk flywheel.

2. Deburrer for continuous steel casting installation for elimination of cutting burrs from continuously cast strand pieces according to claim 1, wherein the debarring carriage drive is structured to travel against the burr with high speed and lifted deburring pistons whilst overtaking the burr from the work piece running out, the deburring carriage drive being structured such that in the event the burr should not be knocked off completely the deburring carriage drive can stop, travel back a short distance and carry out a second deburring stroke against the same burr while travelling forward again.

3. Deburrer for continuous steel casting installation for elimination of cutting burrs from continuously cast strand pieces according to claim 1, wherein a plurality of deburring chisels fixed on the deburring pistons overlapp the latter in both deburring directions and are equipped with unscrewable cutting blades at its ends which are of extremely hard and solid material and which lean on ledges at the base body of the deburring chisel during deburring.

4. A deburring apparatus for removing a burr from a strand piece moving along a longitudinal direction, the debarring apparatus comprising:

a rail apparatus extending in the longitudinal direction;

a deburring carriage movably mounted on the rail apparatus, the deburring carriage including at least a first deburring piston and a deburring drive; and the deburring drive including a first motor, a first drive wheel, and a flywheel, the first motor having a first shaft, the first drive wheel and the flywheel being mounted on the first shaft, the first drive wheel operatively engaging the rail apparatus and being structured to translate the deburring piston in the longitudinal direction.

5. The deburring apparatus as set forth in claim 4, in which the rail apparatus includes a first rack, and in which the first drive wheel is a first pinion, the first pinion being operatively engaged with the first rack.

6. The deburring apparatus as set forth in claim 5, in which the deburring drive further includes at least a first travelling wheel rollably mounted on the rail apparatus.

7. The deburring apparatus as set forth in claim 5, in which the rail apparatus further includes a second rack, and in which the deburring drive includes a second motor and a second pinion, the second motor having a second shaft, the second pinion being mounted on the second shaft and operatively engaged with the second rack, the flywheel being mounted on second shaft and interposed between the first and second shafts.

8. The deburring apparatus as set forth in claim 7, further comprising a piston body mounted on the deburring carriage, the piston body being movably disposed on a sliding rail, the at least first debarring piston being mounted on the piston body.

9. The deburring apparatus as set forth in claim 8, in which the rail apparatus includes a pair of deflect stops, one of the deflect stops being disposed adjacent one end of the sliding rail, the other of the deflect stops being disposed adjacent the other end of the sliding rail, the deflect stops being structured to pivot the piston body through an angle in approximately the range of 60° to 90°.

10. The deburring apparatus as set forth in claim 8, in which the at least first deburring piston includes a deburring chisel; the deburring chisel including at least a first cutting blade removably mounted thereon.

11. The deburring apparatus as set forth in claim 4, in which the first motor is an asynchronous electric motor.

* * * * *